US006911782B2

(12) United States Patent
Jang et al.

(10) Patent No.: US 6,911,782 B2
(45) Date of Patent: Jun. 28, 2005

(54) FIELD EMISSION DISPLAY WITH SEPARATED UPPER ELECTRODE STRUCTURE

(75) Inventors: Jae-eun Jang, Seoul (KR); Jae-eun Jung, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/633,553

(22) Filed: Aug. 5, 2003

(65) Prior Publication Data

US 2004/0032201 A1 Feb. 19, 2004

(30) Foreign Application Priority Data

Aug. 5, 2002 (KR) ..... 10-2002-0046175

(51) Int. Cl.[7] ..... G09G 3/00; H01J 6/62
(52) U.S. Cl. ..... 315/169.3; 313/495
(58) Field of Search ..... 315/169.1, 169.2, 315/169.3, 169.4; 313/495, 496, 336, 351

(56) References Cited

U.S. PATENT DOCUMENTS

| | | | | |
|---|---|---|---|---|
| 6,100,637 | A * | 8/2000 | Kishino et al. | 313/495 |
| 6,624,566 | B2 * | 9/2003 | Uemura et al. | 313/496 |
| 2002/0003399 | A1 * | 1/2002 | Uemura et al. | 313/495 |
| 2002/0084997 | A1 * | 7/2002 | Ohnishi | 345/211 |
| 2003/0127988 | A1 * | 7/2003 | Jo et al. | 315/169.3 |

FOREIGN PATENT DOCUMENTS

| | | |
|---|---|---|
| JP | 08-006521 | 6/1994 |
| JP | 10-334836 | 12/1998 |

OTHER PUBLICATIONS

Notice to Submit Response, issued by the Korean Patent Office On Apr. 29, 2004, Application No. 10–2002–0046175.

* cited by examiner

*Primary Examiner*—Don Wong
*Assistant Examiner*—Minh Dieu A
(74) *Attorney, Agent, or Firm*—Burns, Doane, Swecker & Mathis, L.L.P.

(57) ABSTRACT

A field emission display with a separated upper electrode structure is provided. The field emission display includes: a lower substrate; lower electrodes arranged as stripes on the lower substrate; a field emitter array including a plurality of emitters arranged at a predetermined interval on each of the lower electrodes; an upper substrate which faces the lower substrate; upper electrodes arranged as stripes on the upper substrate to intersect the lower electrodes; and a phosphor array including a plurality of phosphors arranged on the upper electrodes, each phosphor pair of different colors being aligned with a respective one of the emitters, wherein an upper electrode aligned with each emitter is comprised of first and second upper electrodes connected to a respective phosphor pair of different colors. Such an upper electrode arrangement can be achieved through simple processes. In addition, a cross-talk phenomenon is prevented with the upper electrode structure and image quality is enhanced.

8 Claims, 10 Drawing Sheets

FIELD EMISSION DISPLAY WITH SEPARATED UPPER ELECTRODE STRUCTURE

BACKGROUND OF THE INVENTION

This application claims priority from Korean Patent Application No. 2002-46175, filed on Aug. 5, 2002, in the Korean Intellectual Property Office, the disclosure of which is incorporated herein in its entirety by reference.

1. Field of the Invention

The present invention relates to a field emission display, and more particularly, to a field emission display with separate upper electrodes.

2. Description of the Related Art

Field emission displays, like cathode ray tubes (CRTs), display a color image by emitting light of a predetermined color through the bombardment of electrons onto a field emitter array (FEA) coated with phosphor.

The simplest way to display color images on field emission displays is a pixel-to-pixel method or a cathode switching method. In the pixel-to-pixel method, each pixel includes phosphors of different colors arrayed on corresponding anodes. A cathode is driven to hit a phosphor of a desired color with electrons.

FIG. 1 is a sectional view of a conventional field emission display utilizing the switching method. In FIG. 1, "○" denotes applying voltage, and "X " denotes not applying voltage.

Referring to FIG. 1, a field emitter array (FER) 20, including a plurality of emitters 26R, 26G, 26B, 28R, 28G, and 28B, is formed on a cathode 11 and faces an anode 13. Sequences of red, green, and blue phosphors 16R, 16G, and 16B and 18R, 18G, and 18B are arranged on the anode 13 and aligned with the respective emitters 26R, 26G, 26B, 28R, 28G, and 28B. A first pixel 16 includes red, green, and blue phosphors 16R, 16G, and 16B, and a second pixel 18 includes red, green, and blue phosphors 18R, 18G, and 18B. For the convenience of illustration, only two pixels 16 and 18 appear in FIG. 1

The anode 13 is a common electrode through which a voltage is applied to all of the red, green, and blue phosphors 16R, 16G, 16B, 18R, 18G, and 18B, whereas the cathode 11 is comprised of individual electrodes arranged in rows and columns, through which a voltage is selectively applied to those emitters among the emitters 26R, 26G, 26B, 28R, 28G, and 28B that face phosphors of desired colors.

According to the cathode switching method, in order to emit violet (V) light 31 through the first pixel 16, a common voltage is applied to the anode 13, and a voltage is applied only to the emitters 26R and 26B facing red phosphor 16R and blue phosphor 16B to simultaneously emit red light and blue light. In order to emit green light G through the second pixel 18, a common voltage is applied to the anode 13, a voltage is applied to operate only the emitter 28G facing green phosphor 18G to emit green light. The cathode switching method of selectively driving an emitter facing phosphor of a desired color is simple.

However, the cathode switching method may cause cross talk between different colors of light.

For a higher resolution field emission display, phosphors 16R, 16G, 16B, 18R, 18G, and 18B are spaced to be closer together, and the size of the emitters 26R, 26G, 26B, 28R, 28G, and 28B is reduced. When such a higher resolution field emission display is driven using the above-described cathode switching method and an equal amount of voltage is simultaneously applied to all of the red, green, and blue phosphors 16R, 16G, 16B, 18R, 18G, and 18B, electrons emitted from the emitter 26R, which is for exciting red phosphor 16R, may hit green phosphor 16G. Such cross talk degrades color purity or quality of displayed images.

Such a cross-talk phenomenon is illustrated in FIG. 2. Electrons emitted from the emitter 26B, which is for exciting blue phosphor 16B, may reach adjacent green phosphor 16B or red phosphor 18R and emit undesired green or red light. Electrons emitted from the emitter 28G, which is for exciting green phosphor 18G, may reach adjacent red phosphor 18R or blue phosphor 18B.

In addition to the problem of cross talk, the cathode switching method requires more, smaller emitters corresponding to each color of phosphor, so that it is difficult to manufacture and assemble such emitters in a device.

An anode switching method can be applied to drive a color field emission display. In the anode switching method, emitters are designed to excite phosphors of different colors in each frame, and each emitter corresponds phosphors of to the three primary colors.

FIG. 3 is a sectional view of a conventional field emission display utilizing an anode switching method.

Referring to FIG. 3, emitters 20*a* and 20*b* are arranged on a cathode 11 facing an upper substrate 12. A red phosphor 16R, a green phosphor 16G, a blue phosphor 16B, a red phosphor 18R, a green phosphor 18G, and a blue phosphor 18B are arranged on the upper substrate 12 such that each group of red, green, and blue phosphors is aligned with a respective one of the emitters 20*a* and 20*b*. A first pixel 16 includes the red, green, and blue phosphors 16R, 16G, and 16B, which correspond to the emitter 20*a*, and a second pixel 18 includes the red, green, and blue phosphors 18R, 18G, and 18B, which correspond to the emitter 20*b*. First through third anodes 13*a*, 13*b*, and 13*c* are formed in the upper substrate 12. The first anode 13*a* is connected to the red phosphor 16R in the first pixel 16 and the red phosphor 18R in the second pixel 18. The second anode 13*b* is connected to the green phosphor 16G in the first pixel 16 and the green phosphor 18G in the second pixel 18. The third anode 13*c* is connected to the blue phosphor 16B in the first pixel 16 and the blue phosphor 18B in the second pixel 18.

In order to emit violet (V) light 31 through the first pixel 16, as illustrated in (a) of FIG. 3, a voltage is applied to the first anode 13*a* connected to the red phosphor 16R, and a voltage is applied to the cathode 11 to drive only the emitter 20*a* corresponding to the red phosphor 16R. In other words, only the emitter 20*a* of the first pixel 16 is driven to emit electrons, and a voltage is applied to the first anode 13*a* to allow only the red phosphor 16R connected to the first anode 13*a* to be excited by the bombardment of the electrons, so that red light is emitted through the first pixel 16.

Next, as illustrated in (b) of FIG. 3, a voltage is applied to the third anode 13*c* connected to the blue phosphor 16B, and a voltage is applied to the cathode 11 to drive only the emitter 20*a* corresponding to the blue phosphor 16B, so as to bombard and excite only the blue phosphor 16B with electrons emitted from the emitter 20. As a result, blue light is emitted from the first pixel 16 a short time lag after the emission of the red light so that violet (V) light 31 is perceived from the first pixel 16.

In order to emit green (G) light 33 through the second pixel 18, as illustrated in (c) of FIG. 3, a voltage is applied only to the second anode 13*b* connected to the green phosphor 18G in the second pixel 18, and a voltage is applied to the cathode 11 to allow only the emitter 20*b* corresponding to the green phosphor 18G to emit electrons, so that green light is emitted from green phosphor 18G in the second pixel 13.

Unlike the cathode switching method, the anode switching method involves selectively applying a voltage to an anode aligned with a phosphor of a desired color. Accordingly, emitted electrons can be more accelerated toward the phosphor. In addition, the overall manufacturing process is simplified because each emitter needs not to be arranged to be aligned with each color of phosphor. However, the anode switching method requires individual anodes to be separately insulated in order to make it possible to selectively apply a voltage to an anode to obtain a desired color. Insulating three anodes, aligned with each emitter, on a 2-dimensional plane is complicated. In addition, it is impossible to apply a high voltage to the anodes due to the inherent characteristics of insulating materials. The voltage applied to the anodes is lower than when using the cathode switching method, so that the luminance of images displayed on pixels is greatly degraded.

SUMMARY OF THE INVENTION

The present invention provides a field emission display capable of displaying quality, high-luminance images by adopting an improved upper substrate structure including two separate upper electrodes for each emitter. In the field emission display, cross talk, which occurs when a cathode switching method is applied, is prevented. In addition, the field emission display can be manufactured with more ease because fewer anodes, which are aligned with each color of phosphor, correspond to each emitter than in a conventional field emission display utilizing an anode switching method.

In accordance with an aspect of the present invention, there is provided a field emission display comprising: a lower substrate; lower electrodes arranged as stripes on the lower substrate; a field emitter array including a plurality of emitters arranged at a predetermined interval on each of the lower electrodes; an upper substrate which faces the lower substrate; upper electrodes arranged as stripes on the upper substrate to intersect the lower electrodes; and a phosphor array including a plurality of phosphors arranged on the upper electrodes, each phosphor pair of different colors being aligned with a respective one of the emitters, wherein an upper electrode aligned with each emitter is comprised of first and second upper electrodes connected to a respective phosphor pair of different colors.

According to specific embodiments of the field emitter display, the emitters may comprise: a bus electrode layer arranged on a lower electrode such that a portion of the lower electrode is exposed; electron emitter tips formed on the exposed portion of the lower electrode; a gate dielectric layer formed on the bus electrode layer and having a well that surrounds the electron emitter tips; and a gate electrode layer formed on the gate dielectric layer. The electron emitter tips may be metallic tips. Alternatively, the electron emitter tips may be formed of carbon nanotubes or a carbonaceous material.

The phosphor array may include a repeated pattern of a red phosphor, a green phosphor, and a blue phosphor. Two adjacent phosphors of different colors which are aligned with different emitters may be connected to the first and second upper electrodes, respectively. Alternatively, two adjacent phosphors of different colors which are aligned with different emitters are both connected to one of the first and second upper electrodes.

The lower electrodes are cathodes, and the upper electrodes are anodes.

A field emission display according to the present invention has a simple, improved upper electrode structure in which two separate upper electrodes are aligned with each emitter and are connected to a phosphor pair of different colors, so that electrons emitted from each emitter can be effectively accelerated toward a phosphor of a desired color and image quality is enhanced.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
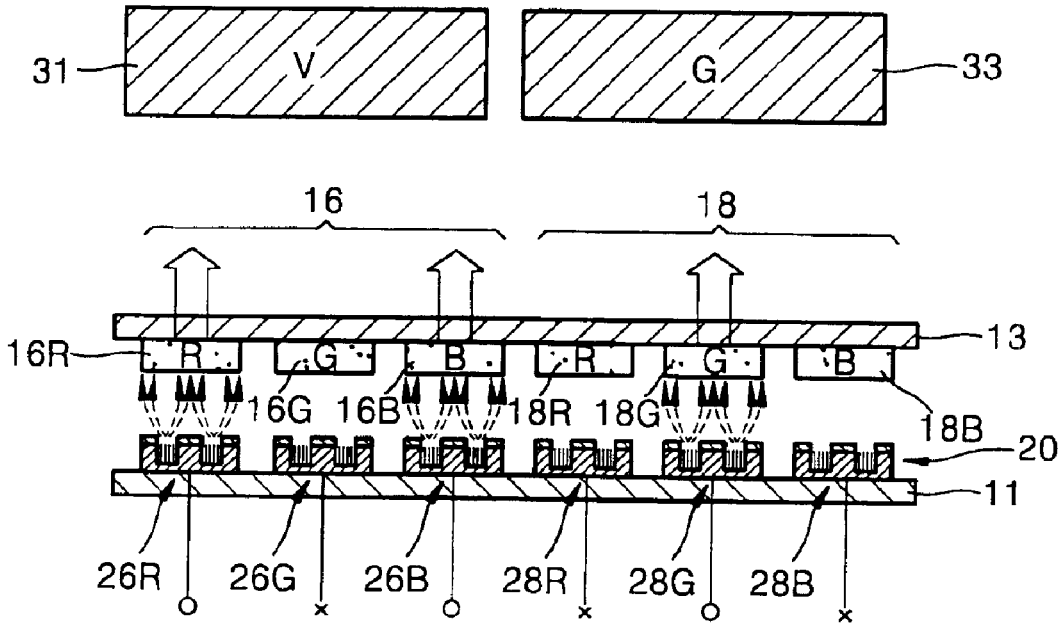
FIG. 1 (PRIOR ART)
FIG. 1 is a sectional view of a conventional field emission display utilizing a cathode switching method.
Figure 2:
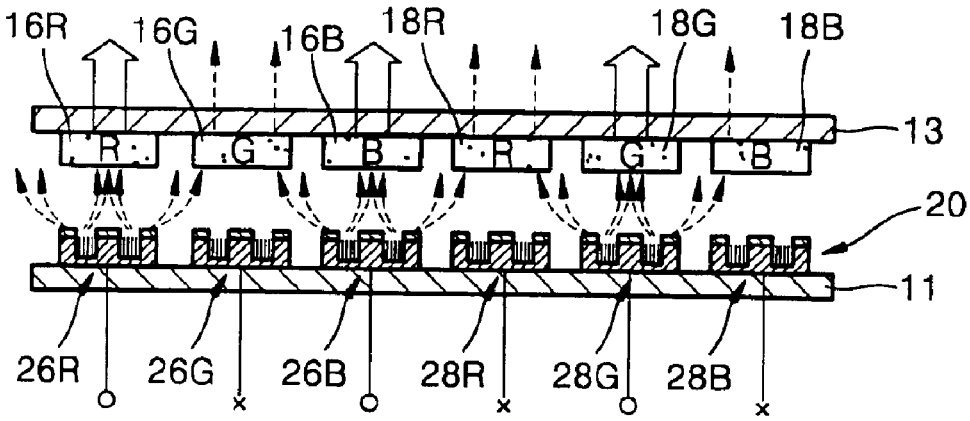
FIG. 2 (PRIOR ART)
FIG. 2 is a sectional view illustrating cross talk in the conventional field emission display utilizing the cathode switching method.
Figure 3:
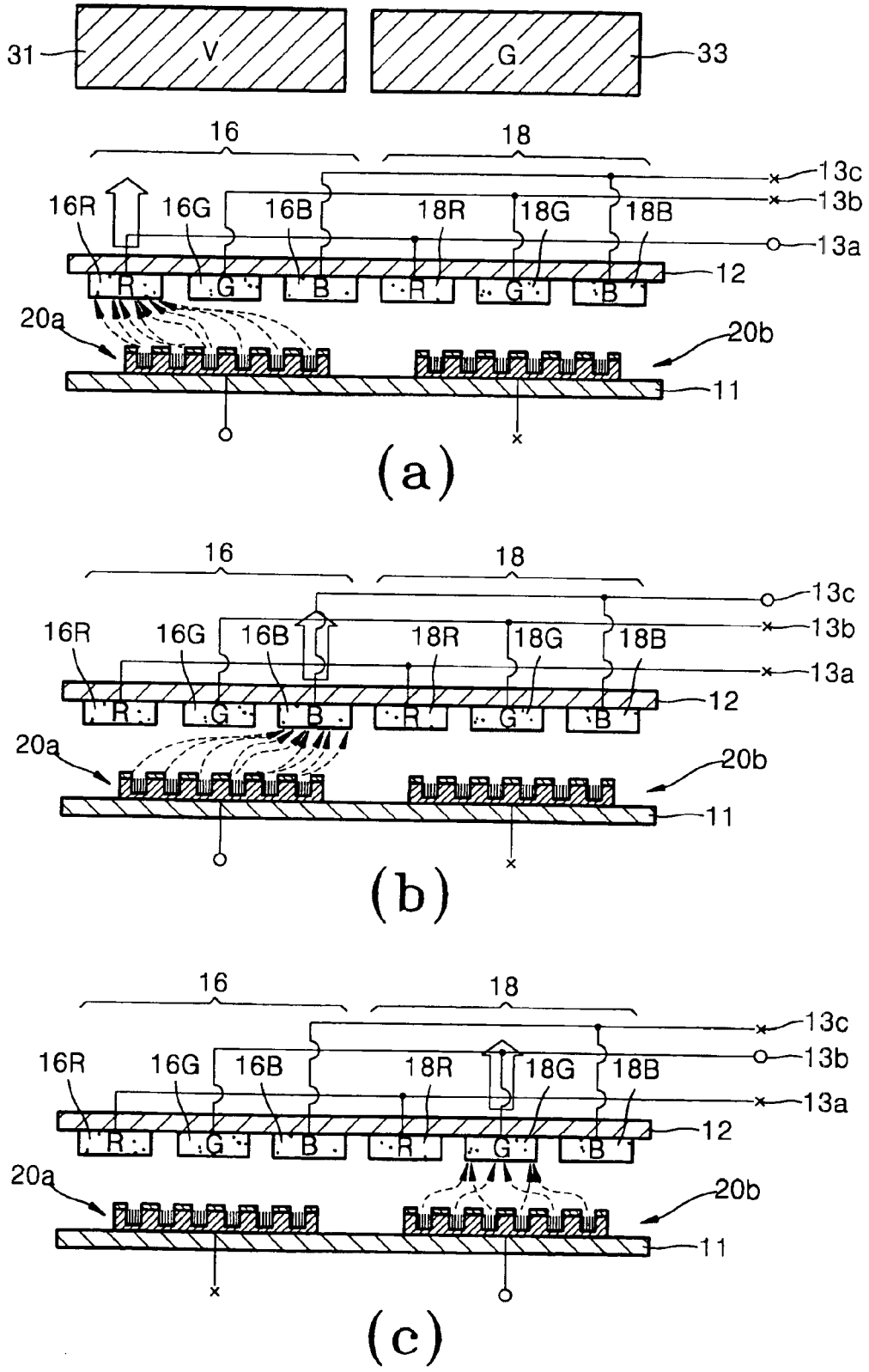
FIG. 3 (PRIOR ART)
FIG. 3 is a sectional view of a conventional field emission display utilizing an anode switching method, in which (a) illustrates the emission of red light in the field emission display, (b) illustrates the emission of blue light, and (c) illustrates the emission of green light.

Embodiments of a field emission display according to the present invention will be described in detail with reference to the appended drawings. Identical reference numerals have been used, where possible, to designate identical elements that are commonly to the drawings. In drawings, "○" denotes applying voltage, and "X" denotes not applying voltage.

Figure 4:
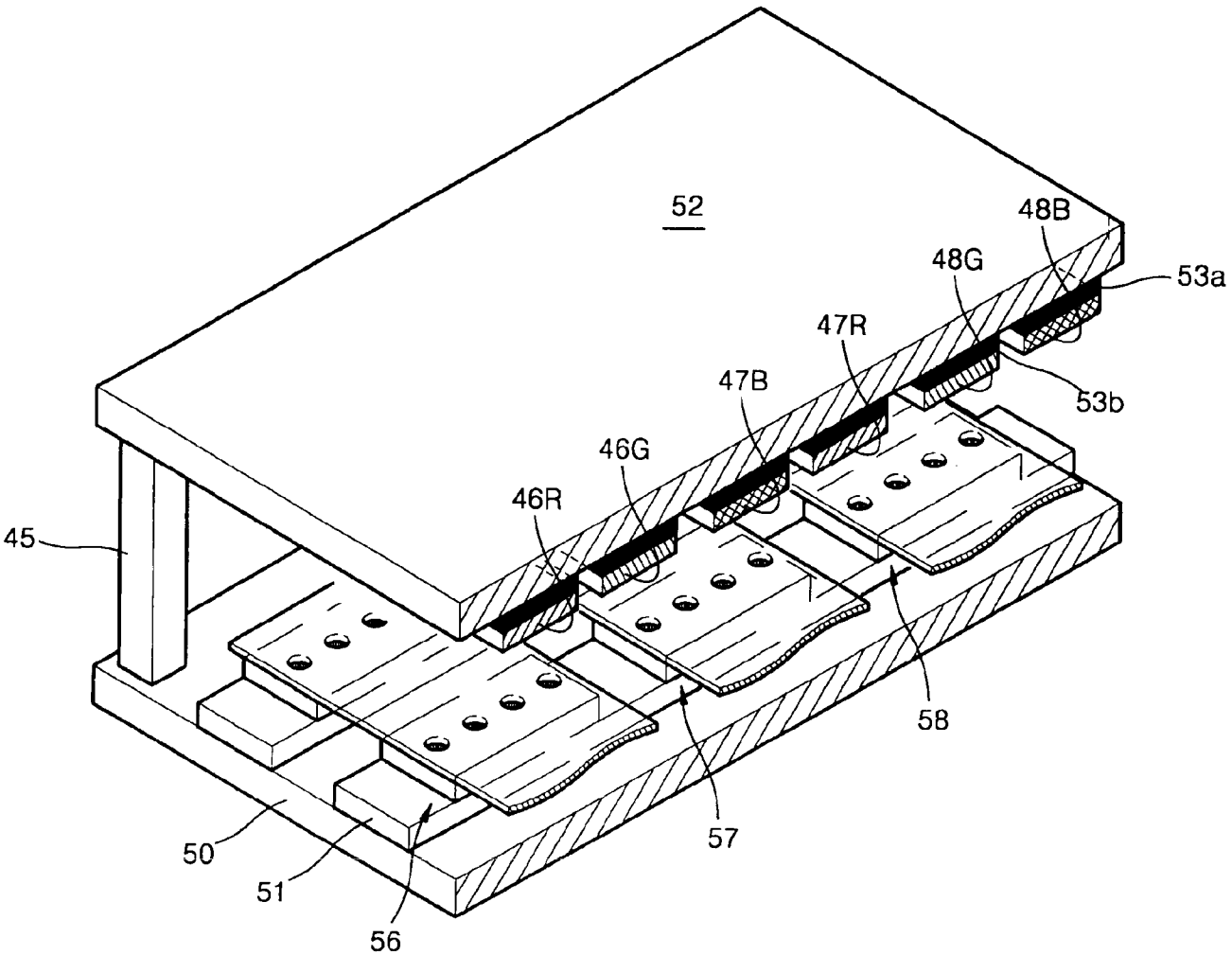
FIG. 4 is a perspective view of a field emission display according to an embodiment of the present invention.

Referring to FIG. 4, a field emission display according to an embodiment of the present invention includes a lower substrate 50 and an opposing upper substrate 52. Cathodes (or lower electrodes) 51 are arranged as stripes on a top surface of the lower substrate 50, and emitters 56, 57, and 58 are arranged on the surface of each of the cathodes 51 at a predetermined interval. Phosphor pairs of different colors, i.e., a pair comprising a red phosphor 46R and a green phosphor 46G, a pair comprising a blue phosphor 47B and a red phosphor 47R, and a pair comprising a green phosphor 48G and a blue phosphor 48B, are arranged on the upper substrate 52 such that each pair is aligned with a respective one of the emitters 56, 57, and 58. Pairs of first and second anodes 53*a* and 53*b* are arranged between the upper substrate 52 and the phosphors 46R, 46G, 47B, 47R, 48G, and 48B such that each anode is aligned with a respective one of the phosphors. Each pair of first and second anodes 53*a* and 53*b* is connected to a phosphor pair of different colors, for example, a pair comprising a red phosphor 46R and a green phosphor 46G, and each phosphor pair is aligned with to an emitter, for example, the first emitter 56. The upper substrate 52 and the lower substrate 50 are separated by a spacer 45.

Figure 5A:
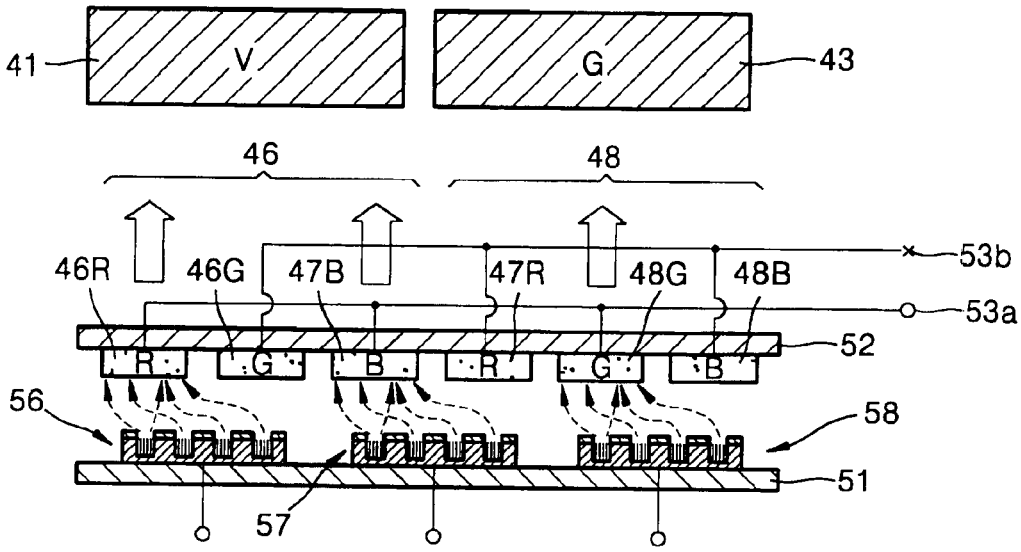
FIG. 5A is a sectional view of the field emission display of FIG. 4 illustrating a driving method for emitting violet light through a first pixel.

FIG. 5A is a sectional view of the field emission display of FIG. 4. The lower substrate (not shown), the cathodes 51, only one of which is shown in FIG. 5A, formed as stripes on the lower substrate, and a field emitter array, which includes the plurality of emitters 56, 57, and 58 formed on each of the cathodes 51, form a lower structure of the field emission display.

The upper substrate 52, which faces the lower substrate 50, the first and second anodes 53*a* and 53*b* arranged on the upper substrate 52 perpendicular to the cathodes 51, and a phosphor array, which include multiple phosphor pairs of different colors, i.e., a pair comprising red and green phosphors 46R, 46G, a pair comprising blue and red phosphors 47B and 47R, and a pair comprising green and blue phosphors 48G and 48B, aligned with each of the emitters 56, 57, and 58, form an upper structure of the field emission display.

As described above, the first and second anodes 53*a* and 53*b* are arranged between the upper substrate 52 and the phosphor array, are aligned with each of the emitters 56, 57, and 58, and are connected with each phosphor pair of different colors, i.e., a pair of red and green phosphors 46R and 46G, a pair of blue and red phosphors 47B and 47G, and a pair of green and blue phosphors 48G and 48B. The red phosphor 46R and the green phosphor 46G aligned with the emitter 56 are connected to the first anode 53*a* and the second anode 53*b*, respectively. Two adjacent phosphors which are aligned with different emitters are connected to the first and second anodes 53*a* and 53*b*, respectively. For example, the red phosphor 46G and the blue phosphor 47B, which are aligned with the emitters 56 and 57, are connected to the second anode 53*b* and the fist anode 53*a*, respectively.

The first pixel 46 includes the red phosphor 46R, the green phosphor 46G, and the blue phosphor 46B, the emitter 56, and a portion of the emitter 57. The second pixel 48 includes the red phosphor 48R, the green phosphor 48G, and the blue phosphor 48B, the emitter 57, and a portion of the emitter 58.

In order to emit violet (V) light 41 through the first pixel 46 and green (G) light 43 through the second pixel 48, as illustrated in FIG. 5A, a voltage is applied to the first anode 53*a*, which is connected with the red phosphor 46R and the blue phosphor 47B of the first pixel 46 and with the green phosphor 48G of the second pixel 48, and a voltage is applied to the emitters 56, 57, and 58, which are aligned with the red phosphor 46R, the blue phosphor 47B, and the green phosphor 48G. Electrons are emitted from the emitters 56, 57, and 58 and bombard the red, blue, and green phosphors 46R, 47B, and 48G by electric fields created between the first anodes 53*a* and the cathode 51, so that red light, blue light, and green light are emitted through the first and second pixels 46 and 48. The red light and the blue light emitted through the first pixel 46 are perceived violet 41, and the green light emitted through the second pixel 43 is perceived just green 43.

Figure 5B:
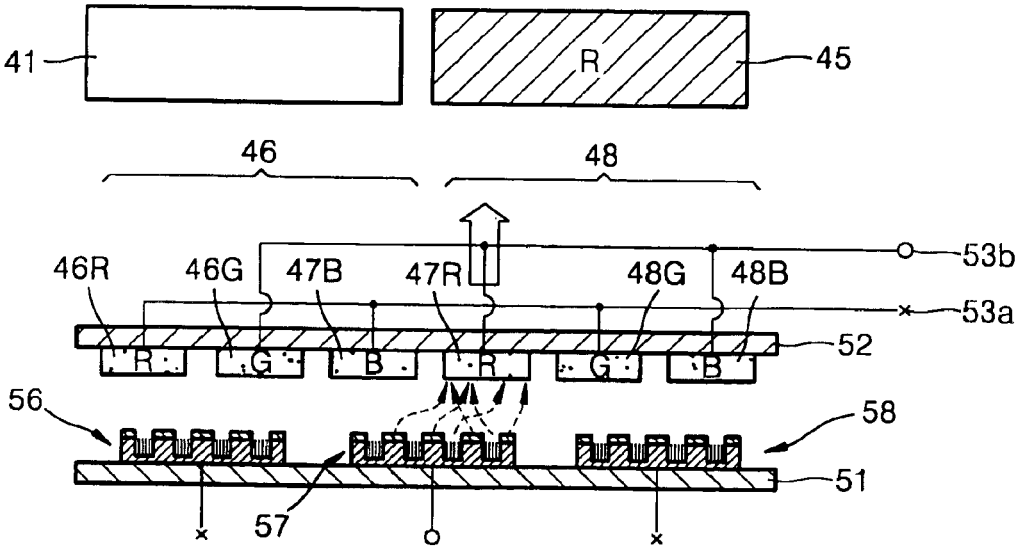
FIG. 5B is a sectional view of the field emission display of FIG. 4 illustrating a driving method for emitting green light through a second pixel.

FIG. 5B illustrates a driving method for emitting red light through the second pixel 43 of the field emission display according to the present invention.

In order to emit red (R) light 45 through the second pixel 43, a voltage is applied to the second anode 53*b*, which is connected with the red phosphor 47R of the second pixel 43, and the cathode 52 is driven such that a voltage is applied only to the emitter 57 aligned with the red phosphor 47R. As shown in FIG. 5B, electrons are emitted from the emitter 57 and bombard the red phosphor 47R so that the red (R) light 45 is emitted and perceived through the second pixel 43.

In the above-described field emission display according to the present invention, an anode that is connected with a phosphor of a desired color in each pixel is selectively driven, and the cathode corresponding to the phosphor of a desired color is driven, so that a full range of colors can be displayed.

In the above field emission display according to the present invention, an upper electrode (anode) aligned with each emitter, arranged on each lower electrode (cathode), is comprised of first and second upper electrodes, which are aligned with phosphors of different colors. Therefore, the anodes and cathodes of the field emission display can be operated more easily and efficiently with this upper electrode structure.

Figure 6:
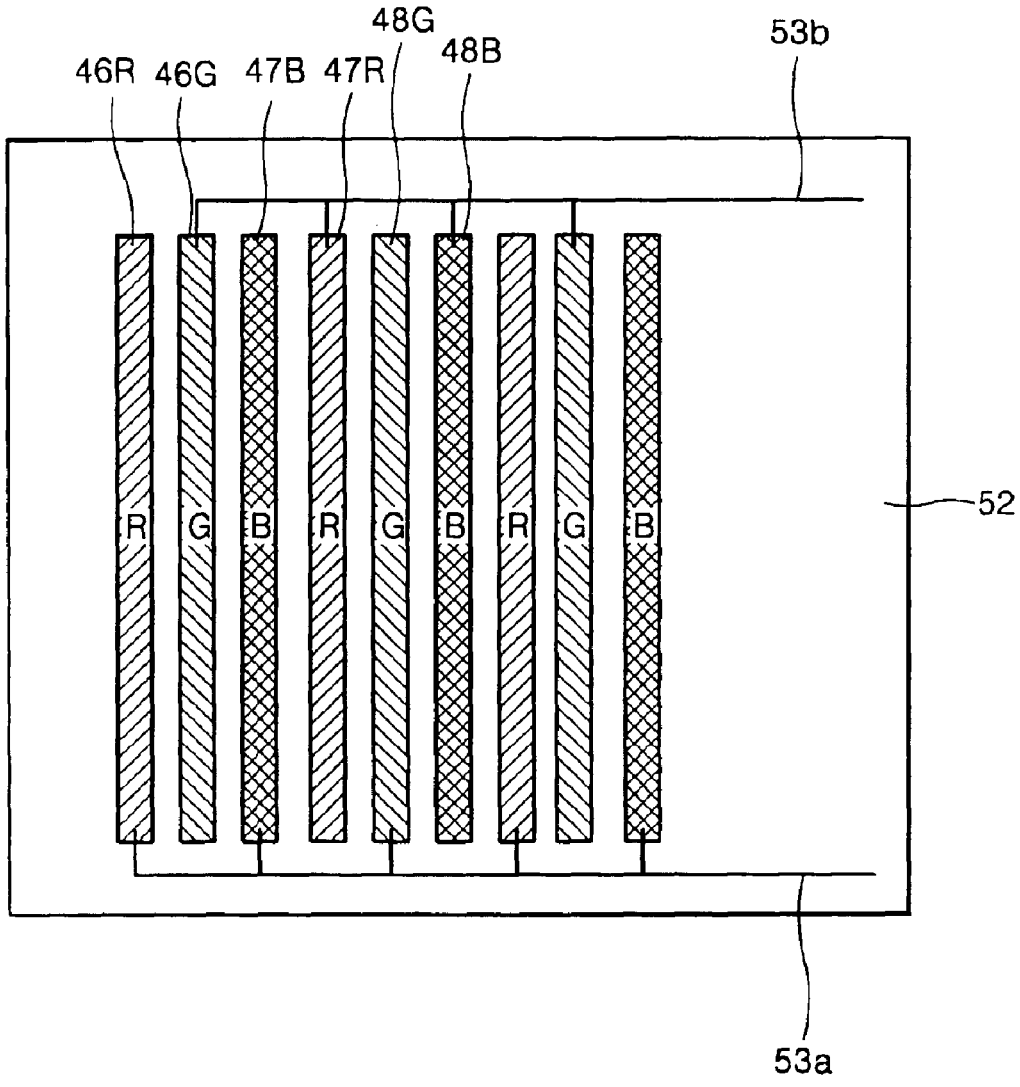
FIG. 6 is a plan view illustrating the arrangement of upper electrodes and phosphors in the field emission display of FIG. 4.

FIG. 6 is a plan view illustrating the arrangement of electrodes (anodes) on the upper substrate of the field emission display according to the present invention. Phosphors 46R, 46G, 48B, 47R, 48G, and 48B are arranged as stripes on the upper substrate 52, wherein each phosphor pair of different colors, i.e., a pair of red and green phosphors 46R and 46G, a pair of blue and red phosphors 48B and 47R, and a pair of green and blue phosphors 48G and 48B, is aligned with a respective one of the emitter 56, 57, and 58. One phosphor of each phosphor pair is connected to the first anode 53*a* and the other is connected to the second anode 53*b*. In the field emission display according to the present invention, an upper electrode aligned with each emitter is comprised of only two anodes, first and second anodes 53*a* and 53*b*, which are connected to each phosphor pair of different colors, so that it is easier to manufacture the upper electrode than conventional anode switching type field emission displays.

Figure 7:
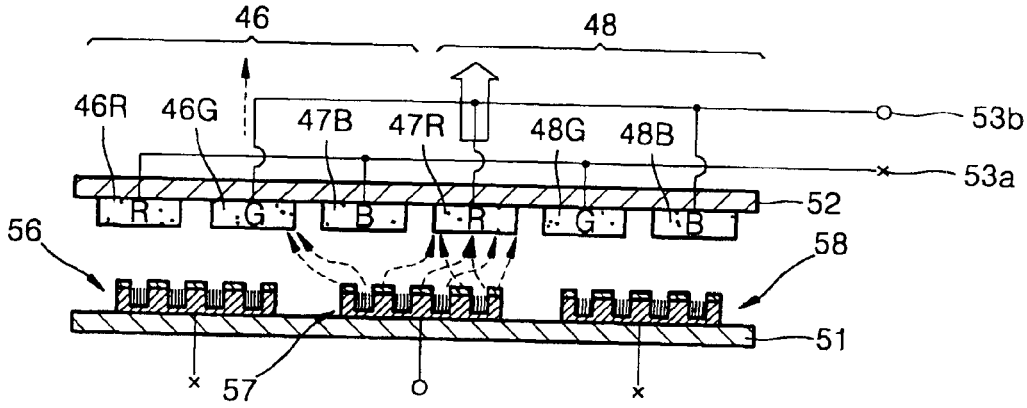
FIG. 7 is a sectional view illustrating cross talk in the field emission display of FIG. 4.

FIG. 7 is a sectional view illustrating a cross-talk phenomenon in the field emission display according to the present invention. When the emitter 57 is activated to emit red light through the second pixel 48, electrons emitted from the emitter 57 may be attracted to the green phosphor 46G of the first pixel 46, which is aligned with the emitter 56 adjacent to the emitter 57, as well as to the red phosphor 47R of the second pixel 48.

Figure 8:
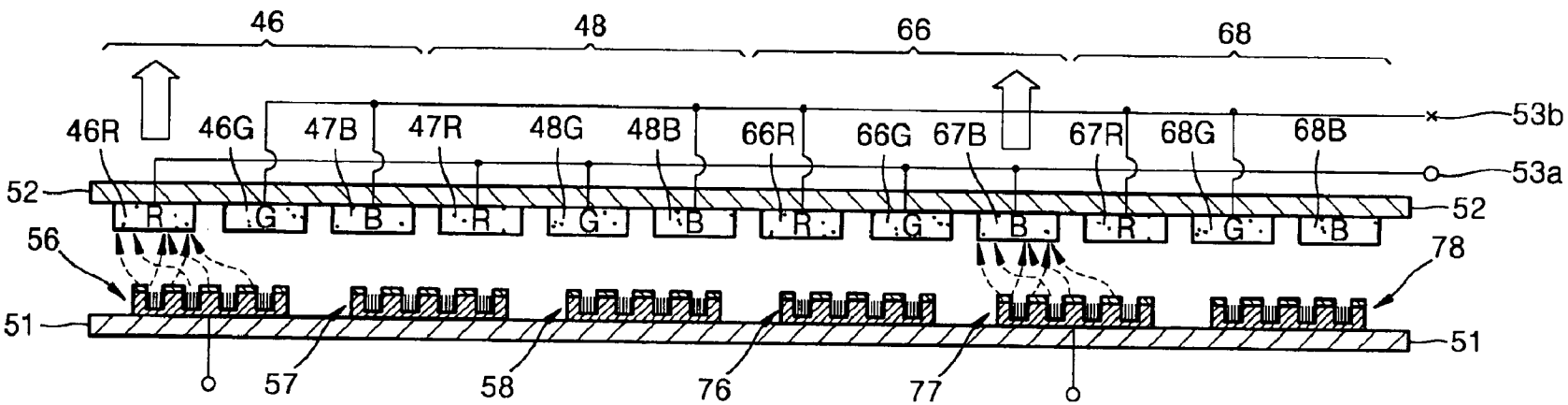
FIG. 8 is a sectional view of a field emission display according to another embodiment of the present invention.

FIG. 8 is a sectional view of a field emission display according to another embodiment of the present invention, in which the arrangement of the first and second anodes 53 and 53*b* is varied to prevent the cross talk phenomenon in the field emission display of FIG. 7.

In the field emission display of FIG. 8, the first and second anodes 53 and 53*b* aligned with each of the emitters 56, 57, 58, 76, 77, and 78 and are connected to each phosphor pair of different colors, i.e., a pair of red and green phosphors 46R and 46G, a pair of blue and red phosphors 47B and 47R, a pair of green and blue phosphors 48G and 48B, a pair of red and green phosphors 66R and 66G, a pair of blue and red phosphors 67B and 67R, and a pair of green and blue phosphors 68G and 68B. Unlike the above embodiment illustrated in FIG. 7, two adjacent phosphors which are aligned with different emitters, for example, the green and blue phosphors 46G and 47B, which are aligned with the emitters 56 and 57, the red and green phosphors 47R and 48G, which are aligned with the emitters 57 and 58, the blue and red phosphors 48B and 66R, which are aligned with the emitters 58 and 76, the green and blue phosphors 66G and 67B, which are aligned with the emitters 76 and 77, and the red and green phosphors 67R and 68G, which are aligned with the emitters 77 and 78, are connected to the same anode, i.e., the first anode 53*a* or the second anode 53*b*. As a result, the spreading of electrons in the field emission display of FIG. 7 is prevented. In FIG. 7, the first pixel 46 includes the red, green, and blue phosphors 46R, 46G, and 47B, the second pixel 48 includes the red, green, and blue phosphors 47R, 48B, and 48B, the third pixel 66 includes the red, green, and blue phosphors 66R, 66G, and 67B, and the fourth pixel 68 includes the red, green, and blue phosphors 67R, 68G, and 68B.

Red light can be emitted through the first pixel 46 by applying a voltage to the first anode 53*a* connected to the red phosphor 46R and activating the corresponding emitter 56. In this state, when the emitter 77 is activated, blue light can be emitted through the third pixel 66.

In the field emission display of FIG. 8 according to the present invention, light of a desired color can be emitted through each pixel by activating anodes connected to corresponding phosphors of desired colors and corresponding cathodes.

Figure 9:
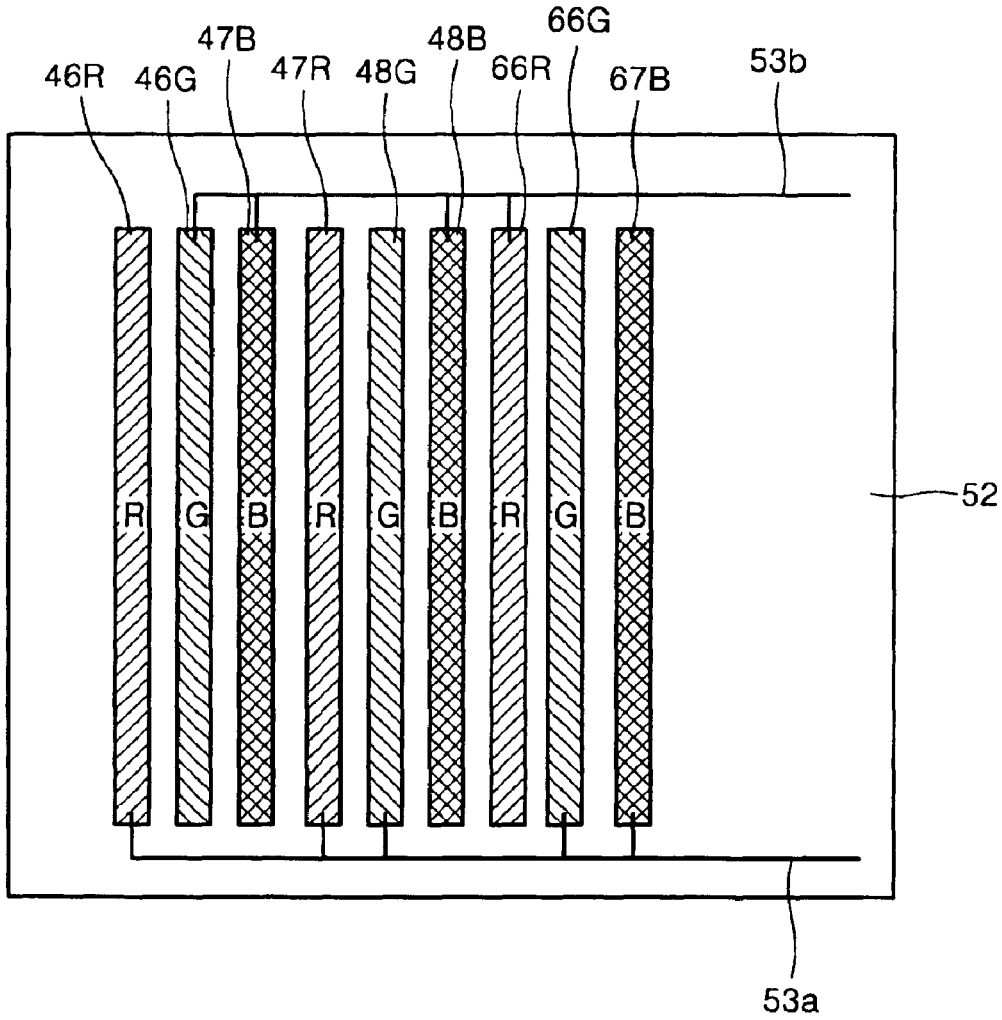
FIG. 9 is a plan view illustrating the arrangement of upper electrodes and phosphors in the field emission display of FIG. 8.

FIG. 9 is a plan view of the upper substrate of the field emission display of FIG. 8. In FIG. 9, on the upper substrate 52, the two adjacent phosphors 46G and 47B, which are aligned with the different emitters 56 and 57 in FIG. 8, are both connected to the second anode 53*b*, and the two adjacent phosphors 47R and 48G, which are aligned with the different emitters 57 and 58 in FIG. 8, are both connected to the first anode 53*a*. The upper electrode structure of the field emission display of FIG. 9 can prevent spreading of electrons because two adjacent phosphors which are aligned with different emitters are connected to the same anode, unlike the upper electrode structure of the field emission display of FIG. 6.

Figure 10A:
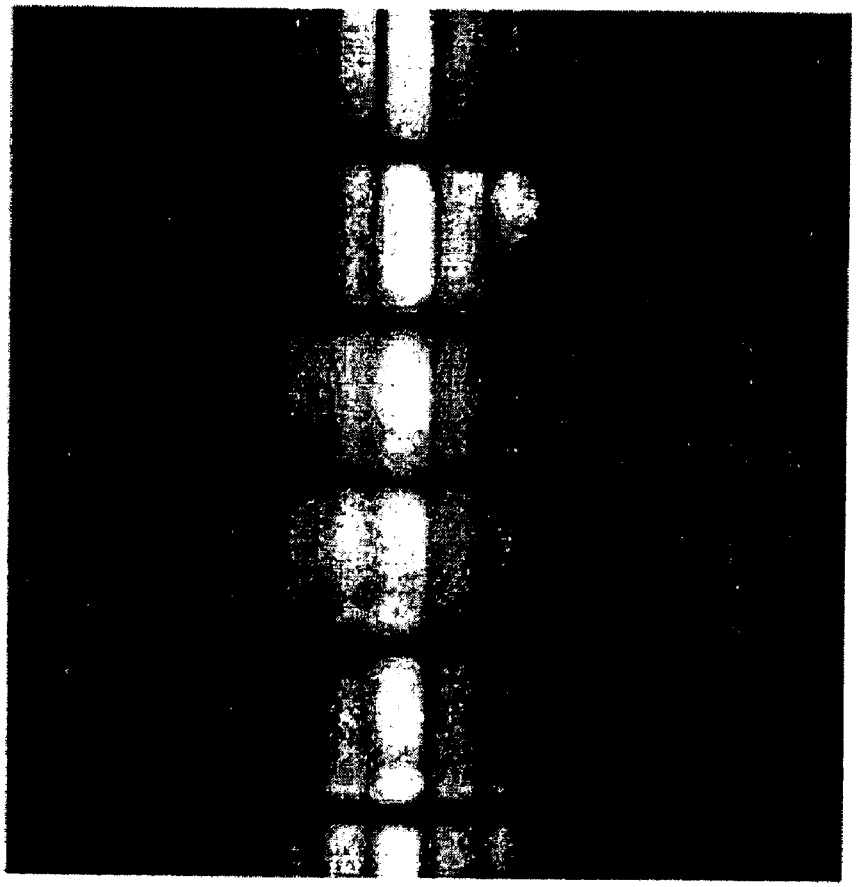
FIG. 10A (PRIOR ART)
FIG. 10A is a photograph of a light emission range of a conventional field emission display utilizing a cathode switching method.
Figure 10B:
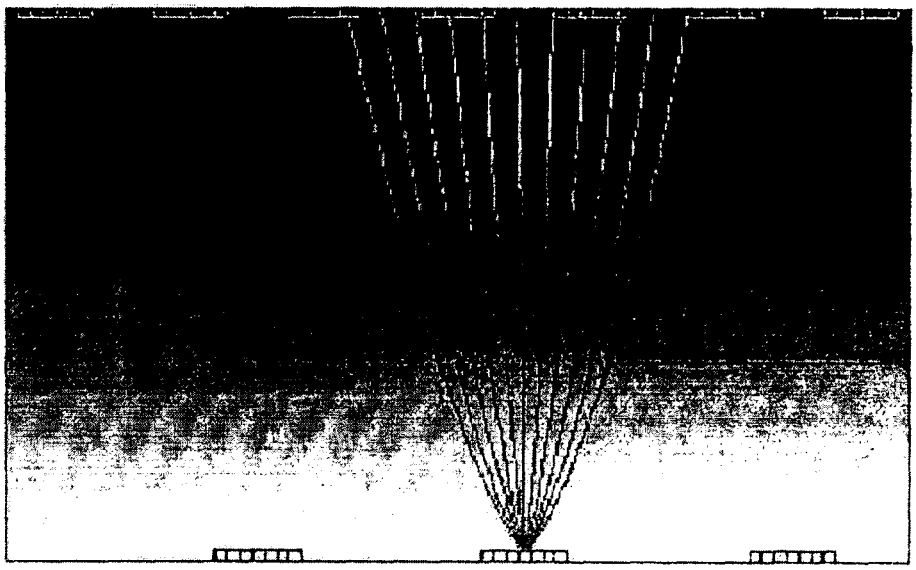
FIG. 10B (PRIOR ART)
FIG. 10B illustrates the spreading of electrons toward anodes in the conventional field emission display of FIG. 10A.

FIG. 10A is a photograph of a light emission range of a conventional field emission display utilizing a cathode switching method. FIG. 10B illustrates the spreading of electrons toward anodes in the conventional field emission display of FIG. 10A.

Figure 11:
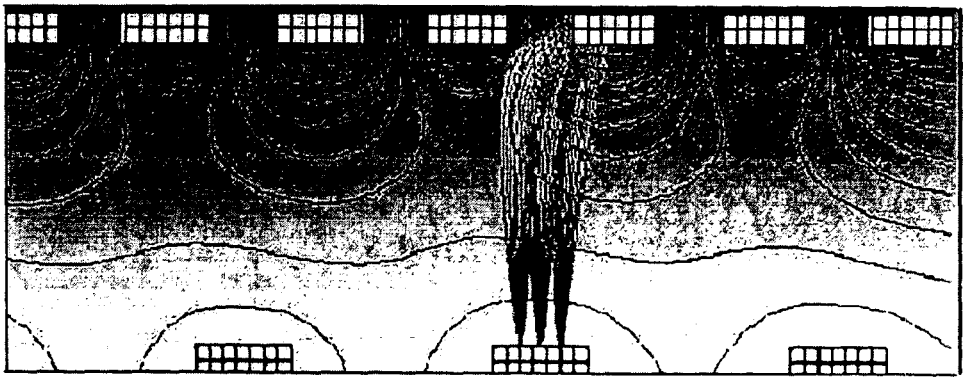
FIG. 11 illustrates the result of operating the field emission display of FIG. 8 according to the present invention under the same conditions as the conventional emission display of FIG. 10B.

FIG. 11 illustrates the result of operating the field emission display of FIG. 8 according to the present invention under the same conditions as the conventional emission display of FIG. 10B. As is apparent from FIG. 11, electrons emitted from an emitter are accelerated straight toward a corresponding phosphor.

In a field emission display according to the present invention, two phosphors of different colors are aligned with each emitter, and the two phosphors are connected to separate upper electrodes. Such an upper electrode structure can be achieved through simpler processes compared to conventional field emission displays. In addition, the cross-talk phenomenon is prevented and image quality is improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission display comprising:

a lower substrate;

lower electrodes arranged as stripes on the lower substrate;

a field emitter array including a plurality of emitters arranged at a predetermined interval on each of the lower electrodes;

an upper substrate which faces the lower substrate;

upper electrodes arranged as stripes on the upper substrate to cross the lower electrodes in a plan view; and a phosphor array including a plurality of phosphor pairs arranged on the upper electrodes, each phosphor pair of different colors being aligned with a respective one of the emitters, wherein an upper electrode aligned with each emitter is comprised of first and second upper electrodes connected to a respective phosphor of said phosphor pairs of different colors.

2. The field emission display of claim 1, wherein the emitters comprise:

a bus electrode layer arranged on a lower electrode such that a portion of the lower electrode is exposed;

electron emitter tips formed on the exposed portion of the lower electrode;

a gate dielectric layer formed on the bus electrode layer and having a well that surrounds the electron emitter tips; and a gate electrode layer formed on the gate dielectric layer.

3. The field emission display of claim 2, wherein the electron emitter tips are metallic tips.

4. The field emission display of claim 2, wherein the electron emitter tips are formed of carbon nanotubes or a carbonaceous material.

5. The field emission display of claim 4, wherein two adjacent phosphors of different colors which are aligned with different emitters are both connected to one of the first and second upper electrodes.

6. The field emission display of claim 1, wherein the phosphor array includes a repeated pattern of a red phosphor, a green phosphor, and a blue phosphor.

7. The field emission display of claim 1, wherein two adjacent phosphors of different colors which are aligned with different emitters are connected to the first and second upper electrodes, respectively.

8. The field emission display of claim 1, wherein the lower electrodes are cathodes, and the upper electrodes are anodes.

* * * * *